US007612667B2

(12) United States Patent
Montague

(10) Patent No.: US 7,612,667 B2
(45) **Date of Patent: *Nov. 3, 2009**

(54) SECURED AND ALARMED WINDOW AND ENTRY WAY

(76) Inventor: Marybeth W. Montague, 4615 N. 22nd St., #112, Phoenix, AZ (US) 85016

( * ) Notice: Subject to any disclaimer, the term of this patent is extended or adjusted under 35 U.S.C. 154(b) by 235 days.

This patent is subject to a terminal disclaimer.

(21) Appl. No.: 11/553,366

(22) Filed: Oct. 26, 2006

(65) Prior Publication Data

US 2008/0100465 A1 May 1, 2008

(51) Int. Cl.
*G08B 13/08* (2006.01)

(52) U.S. Cl. ..... 340/545.1

(58) Field of Classification Search ..... 340/540, 340/545.7, 550, 555.8, 657, 541, 542, 545.1; 160/10

See application file for complete search history.

(56) References Cited

U.S. PATENT DOCUMENTS 4,146,293 A * 3/1979 Mutton et al. ..... 340/550
4,642,612 A 2/1987 Crump
4,878,314 A 11/1989 Blockinger
4,999,608 A 3/1991 Galomb
5,056,262 A * 10/1991 Schweiss et al. ..... 49/56
5,450,888 A 9/1995 Schwartzman
6,049,287 A * 4/2000 Yulkowski ..... 340/693.12
6,570,498 B1 * 5/2003 Frost et al. ..... 340/540
6,998,981 B1 2/2006 Montague
2002/0036476 A1 * 3/2002 Zengguang et al. ..... 318/480
2003/0019172 A1 * 1/2003 Martin ..... 52/197
2005/0030179 A1 * 2/2005 Script et al. ..... 340/545.1
2006/0179719 A1 * 8/2006 Christie ..... 49/169

* cited by examiner

*Primary Examiner*—Phung Nguyen
(74) *Attorney, Agent, or Firm*—Parsons & Goltry; Michael W. Goltry; Robert A. Parsons

(57) ABSTRACT

An alarm and security system is incorporated with a screen unit that may be a part of a window or a part of a patio door or the like. The screen unit is formed of robust expanded metal mesh to discourage intrusion therethrough. A plurality of locks about the frame of the screen unit lock the screen unit with a supporting frame. A control unit is coupled with sensors for sensing motion of the screen unit or tampering with the screen unit to activate audible, inaudible and/or visible alarms at a local or remote location. A camera, activated by the sensors provides an image upon tampering or intrusion of the screen unit. If the screen unit is a screen door, a pet door in the screen door is locked in place to prevent intrusion but a signal generating element on a pet will release the lock when the pet is in close proximity. A remote receiver may be used to receive an alarm signal from the control unit.

27 Claims, 5 Drawing Sheets

SECURED AND ALARMED WINDOW AND ENTRY WAY

BACKGROUND OF THE INVENTION

1. Field of the Invention

The present invention relates to anti-intrusion entry ways for dwellings and, more particularly, to security and alarm apparatus for preventing and detecting unauthorized intrusion.

2. Description of Related Prior Art

Most screens used with doors at entry ways and in windows in a house or apartment are constructed of relatively easily penetrable plastic or metal mesh material. Despite any lock that may be used in conjunction with the screen frame and the door jam, an intruder can easily cut or otherwise cause an opening in the screen material to gain entry. As set forth in U.S. Pat. No. 6,998,981, the present inventor has invented a secure screen formed of a robust metal mesh and locking devices that interconnect the screen frame with the surrounding door frame. The robust metal mesh is of sufficient impediment to prevent intrusion therethrough except for the most determined intruder. Moreover, the locks between the screen frame and the door frame serve in the conventional manner to prevent opening of the screen door. Further details of this invention are set forth in the inventor's patent.

SUMMARY OF THE INVENTION

The present invention is directed to a screen for a door or a window having a robust mesh that is not easily cut or otherwise rendered asunder to permit an intruder passage therethrough. Several locks may be employed to lockingly secure the screen door with its frame. The screen and its frame may be armed to provide a local or remote audible and/or visually perceivable indication of unauthorized tampering or intrusion. A camera may be triggered upon intrusion to provide photographic evidence of the intruder. Such camera may use conventional film or may be a digital camera that records the image in a memory or in real time. To accommodate entry and exit of pets, an appropriately sized hinged door may be formed in the screen door. To prevent human intrusion through the pet door, it may include a magnetically actuated, infrared frequency actuated, radio frequency actuated or non audible frequency actuated locking element. Upon the approach of a pet, a magnet or a suitable transmitter secured to the pet's collar provides the requisite signal to the lock to open the lock and permit passage of the pet through the pet door.

It is therefore a primary object of the present invention to provide a screen to prevent tampering or unauthorized intrusion through a door or a window into a dwelling without setting off one or more alarms.

Another object of the present invention is to provide a screen having any of several selectable alarm systems for indicating the presence of an intruder or tampering by an unauthorized person.

Yet another object of the present invention is to provide a visually perceivable image of an unauthorized intruder entering through or tampering with a screen.

A further object of the present invention is to provide a secure screen door that accommodates passage of pets therethrough without compromising the security of the screen door.

A yet further object of the present invention is to provide a pet door for use in conjunction with a secure screen door having a locking mechanism releaseable by proximity of a pet.

A still further object of the present invention is to provide a method for preventing unauthorized intrusion through a secure screen door while accommodating day to day activities and including the passage of pets therethrough.

These and other objects of the present invention will become apparent to those skilled in the art as the description thereof proceeds.

BRIEF DESCRIPTION OF THE DRAWINGS

The present invention will be described with greater specificity and clarity with reference to the following drawings, in which.

DESCRIPTION OF THE PREFERRED EMBODIMENT

Figure 1:
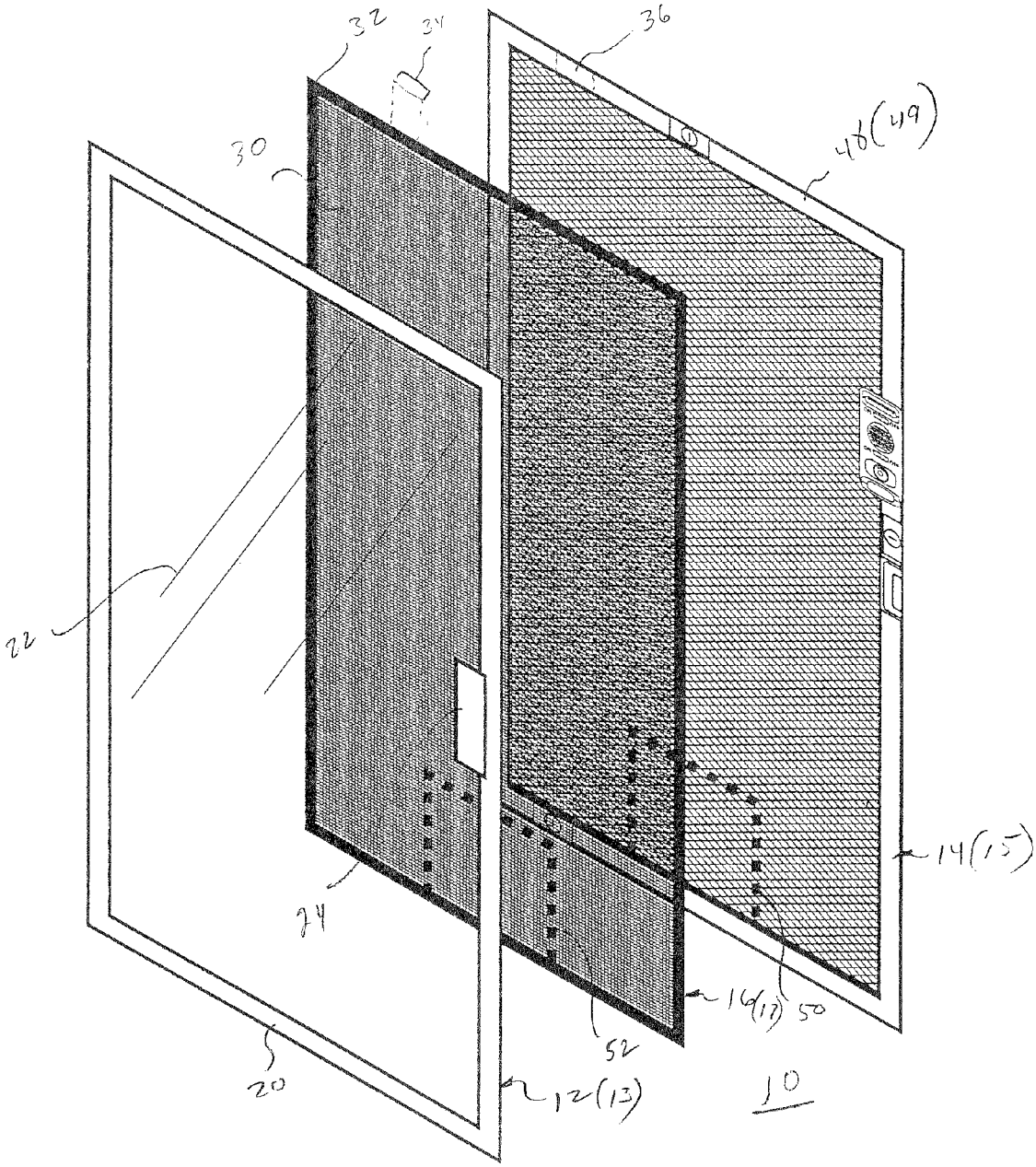
FIG. 1 is an exploded view illustrating a conventional sliding glass door, a magnetically attachable insect screen and a secure screen door, this figure can also be construed to depict a window having the same components.

Referring to FIG. 1, there is shown an exploded view of a door unit 10 particularly suited as a patio door. It includes a conventional glass door 12, a secure screen door 14 embodying features of the present invention and a detachably attached insect screen 16. Door unit 10 may be incorporated as part of a patio door or similar location wherein a glass door is preferred to provide transmission of light therethrough and yet protect against the elements. Alternatively, it can be used as a front or a back door wherein the glass door would be replaced by a wooden or metal door. The main purpose of screen door 14 is that of preventing unauthorized intrusion primarily when the glass door is open and details of the screen door will be described below. The primary purpose of insect screen 16 is to provide a fine mesh to prevent intrusion of insects, debris and the like when the glass door is open. It is to be understood that FIG. 1 and the related figures are also representative of a window having a sliding glass window 13, having an insect screen 17 and a secure screen window 15 with a frame 49.

Glass door 12 includes a frame 20 which may have rollers for sliding movement, as is conventional for a patio door. The frame surrounds a glass panel 22. A manually operated latch 24 is used in the conventional manner to lock and unlock the glass door. It may include a key operated lock or simply a sliding lock, as is conventional. Insect screen 16 includes a screen 30 of a mesh sufficiently fine to prevent passage of insects therethrough. Additionally, it will prevent passage of blown debris. A border 32, which may be rigid or flexible, surrounds and retains insect screen 30. Preferably, border 32 is of magnetic material for detachably attaching the insect screen to the frame of screen door 14. Necessarily, the frame of the screen door must be of magnetically responsive material. Alternatively, border 32 may include one or more magnets as representatively identified by numeral 34 spaced along border 32 for magnetic cooperation with either the frame of screen door 14 or magnetically responsive strips, representatively identified by numeral 36, spaced along the frame of the screen door commensurate with the spacing of magnets 34.

Figure 2:
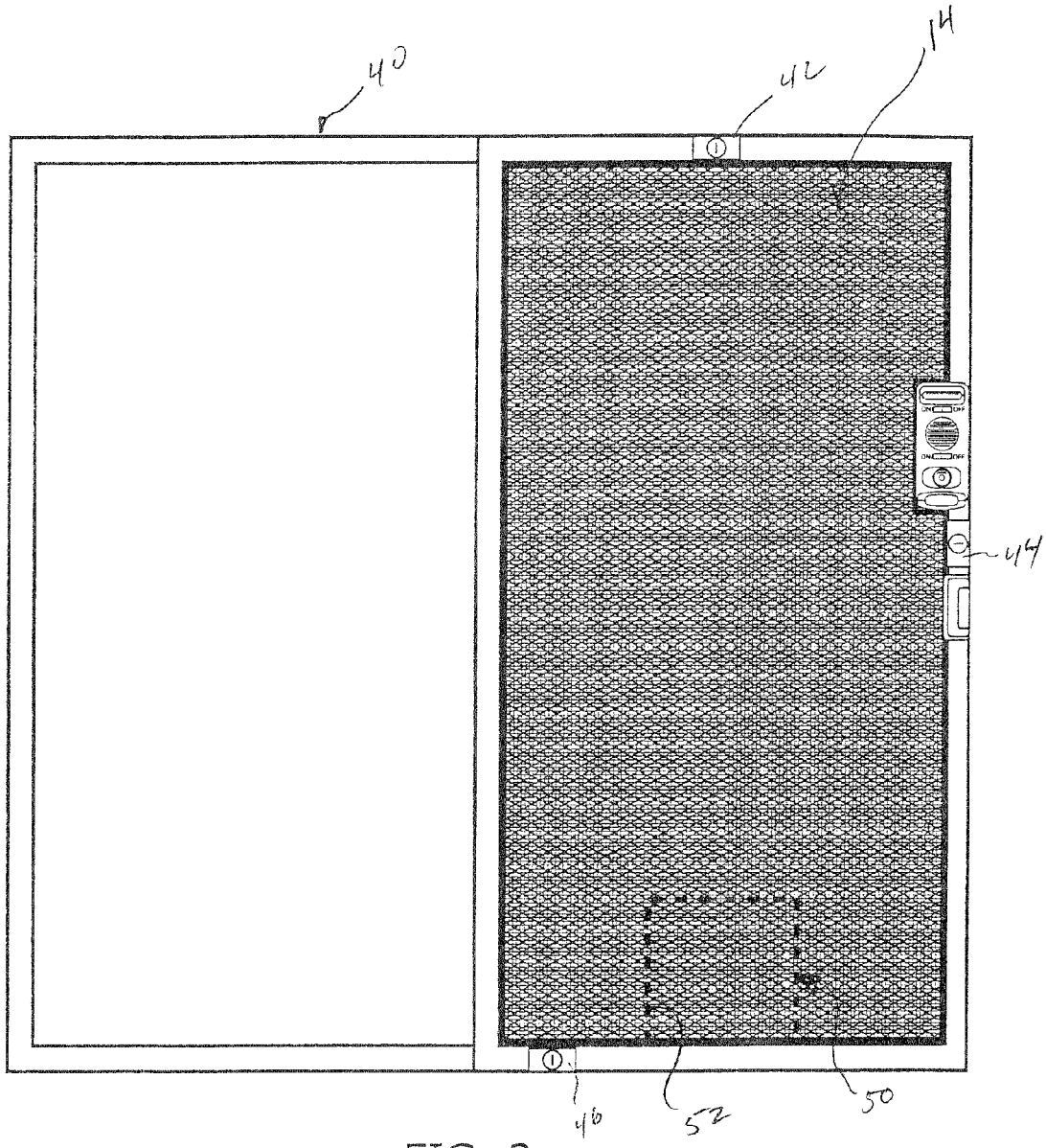
FIG. 2 illustrates installation of the present invention within a conventional door frame.

For purposes of clarity, only screen door 14 is shown in FIG. 2 disposed in door frame 40. As an option, a pet door 50 may be formed in screen door 14 to permit passage of a pet therethrough. Similarly, insect screen 16, if used, would have an opening 52 commensurate with the size and location of pet door 50. In FIGS. 1 and 2, both the pet door and the opening are shown in dashed lines.

Referring jointly to FIGS. 1 and 2, further details of screen door 14 will be described. A door frame 40 of the conventional type slidably supports unit 10 in the conventional manner. Necessarily, it includes latching elements for cooperation with latch 24 on glass door 12. Screen door 14 includes a plurality of locks, of which locks 42, 44 and 46 are shown disposed in frame 48. It is to be understood that the fourth side of the frame may also include a lock and additional locks may be employed spaced at selected locations along the frame.

Figure 3:
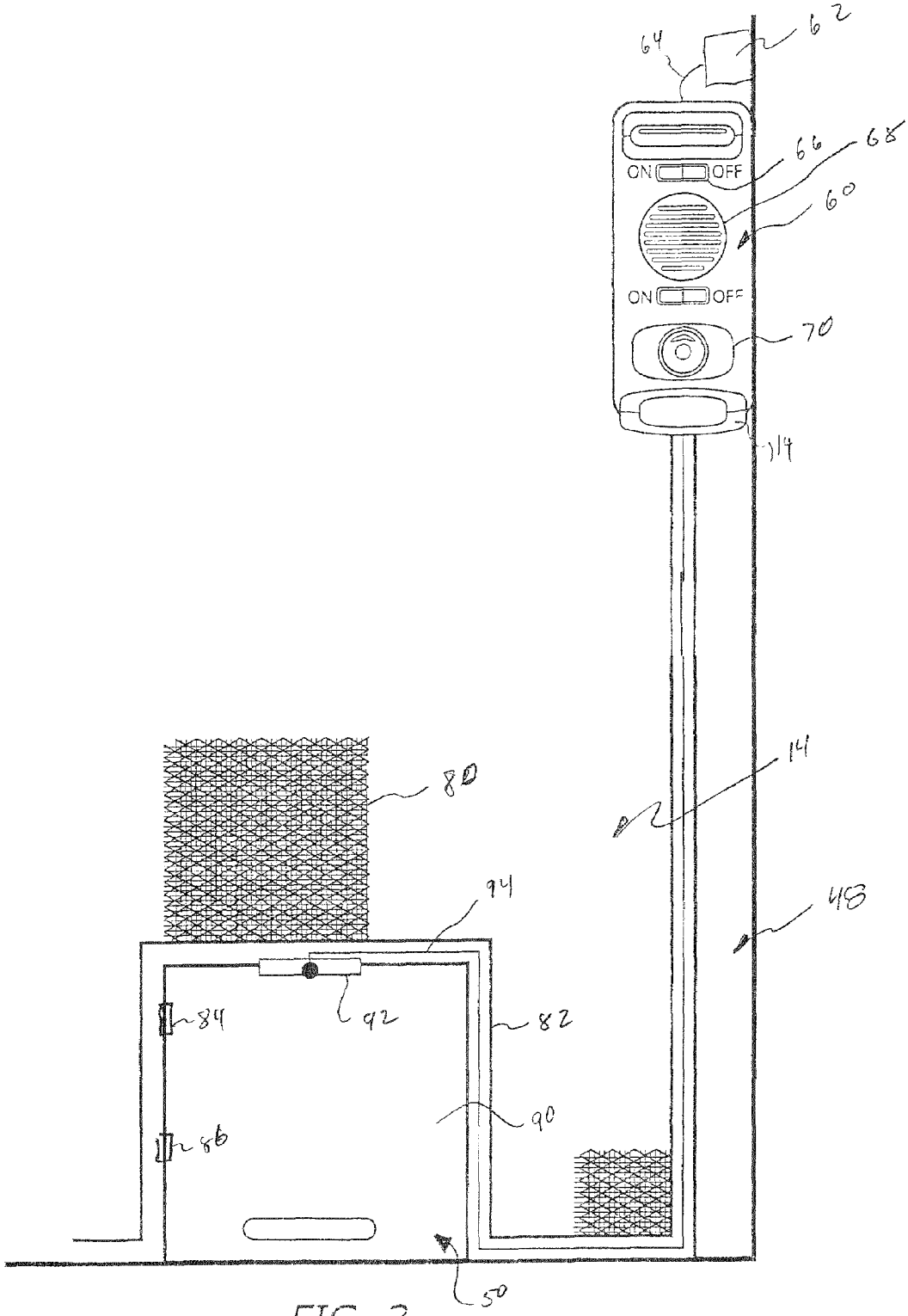
FIG. 3 illustrates in part, a pet door useable in conjunction with the present invention.
Figure 4:
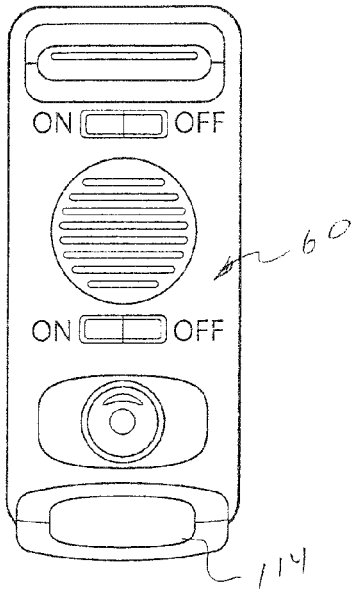
FIG. 4 illustrates a control unit for arming the screen door and for generating an alarm.

Details of the security feature of the present invention will be described with joint reference to FIGS. 1, 2 and 3. A control unit 60 may be mounted on screen door 14 or screen window 15 or other location to control activation and deactivation of various sensors and sensing elements to generate an alarm signal. A plurality of sensors, of which only sensor 62 is shown in FIG. 3, are used to sense movement of the screen door (screen window) that would be reflective of tampering. Each of these sensors may be of the motion detection type. Alternatively, they may be of the type that breaks a circuit upon movement of the screen door. Other sensors, including magnetic types, for generating a signal upon disturbance of the screen door may be used. All of such sensors are readily commercially available. Each of sensors 62 may be hard wired to control unit 60, as represented by conductor 64. Alternatively, each of the sensors may emit a low power radio frequency (RF) or infrared (IR) frequency signal upon actuation, which signal is sensed by a receiver in the control unit. Activation and deactivation of sensors 62 may be accomplished by an on/off switch 66. Upon activation of a sensor due to unauthorized movement (or tampering) of the screen door (screen window 15), an audible or inaudible alarm may activate a speaker, as represented by apertured cover 68 protecting a loud speaker, activate one or more lights, or transmit a signal to a remote receiver. To provide an indication of the identity of an intruder, a camera 70 may be incorporated in the control unit or at another location. This camera, whether film or digital, would be turned on to obtain an image of the intruder upon activation of one of sensors 62. It is to be understood that in addition to these indicators of the presence of an intruder, control unit 60 may be connected to a telephone system to provide an emergency call to a local police station or to a security company to raise an alarm of an unauthorized intrusion or tampering. The signal transmitted by the alarm may include an identifier to identify the location of tampering or intrusion.

As shown in more detail in FIG. 3, the screen door is formed of a robust mesh 80 of expanded metal to provide air flow therethrough and yet serve as a significant deterrent to tampering or intrusion. Further details of this mesh is described in the present inventor's patent, U.S. Pat. No. 6,998,981, which patent is incorporated by reference herein. If a pet door 50 is incorporated, as shown in FIG. 3, mesh 80 would necessarily surround frame 82 of the pet door.

Referring jointly to FIGS. 3, 5, 7 and 8, further details of the pet door and its operation will be described. The pet door includes a panel 90 hingedly attached to frame 82 such as by hinges 84, 86. It is to be understood that the pet door may be relatively rigid or of robust but flexible material, such as a rubber or plastic mat material. Panel 90 is lockingly engaged with frame 82, as representatively illustrated by lock 92. In the event this lock is not released, as will be described below, and panel 90 is forced open, a signal will be generated by lock 92, which signal may be of the make or break type of mechanism (such as a magnetic switch, mercury switch or mechanical switch), via conductor 94 to control unit 60. The signal will set off the control unit to provide an alarm. It is to be understood that the depicted locations of hinges 84, 86 and lock 92 are representative and may be changed.

Figure 5:
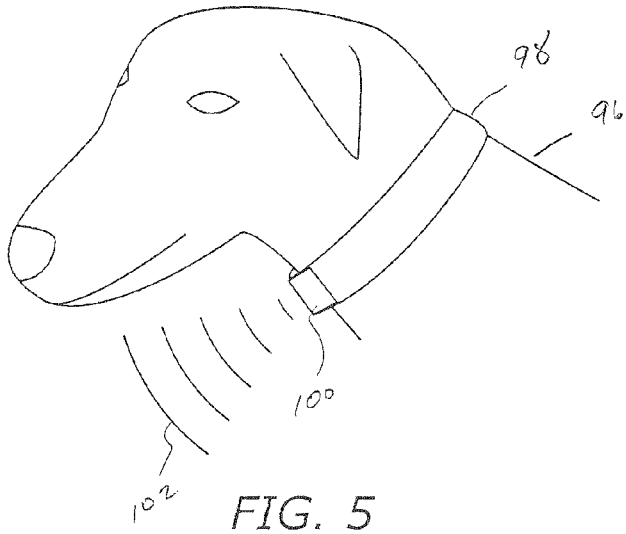
FIG. 5 illustrates a pet having a collar mounted magnet or transmitter for releasing the lock on a pet door.

Release of lock 92 securing panel 90 on pet door 50 may be accomplished by the pet. As shown in FIG. 5, a pet, such as dog 96 named Bear, is provided with a collar 98 which supports a signal generating element, such as a low power radio frequency (RF) or infrared (IR) transmitter 100. The transmitted signal, as represented by lines 102 is sensed by lock 92. Upon such sensing, the lock will automatically unlock and permit pivotal movement of panel 90 to permit the pet passage through pet door 50. Necessarily, the power of transmitter 100 must be very low to prevent unlocking of lock 92 unless the pet is relatively close. Alternatively, collar 98 may include a magnet 104 as the signal generating element to create a magnetic field in proximity to lock 92 when the pet is close by. The magnetic field is sensed by lock 92 and the lock becomes unlocked upon such sensing. In a third embodiment, collar 98 may include a generator 106 for generating a signal above the audible range for both humans and pets so as not to be disturbing to either humans or pets. This signal may be sensed by lock 92 and upon such sensing the lock would unlock. Necessarily, the volume of the signal must be relatively low to prevent unlocking of lock 92 except when the pet is in close proximity to pet door 50.

Figure 6:
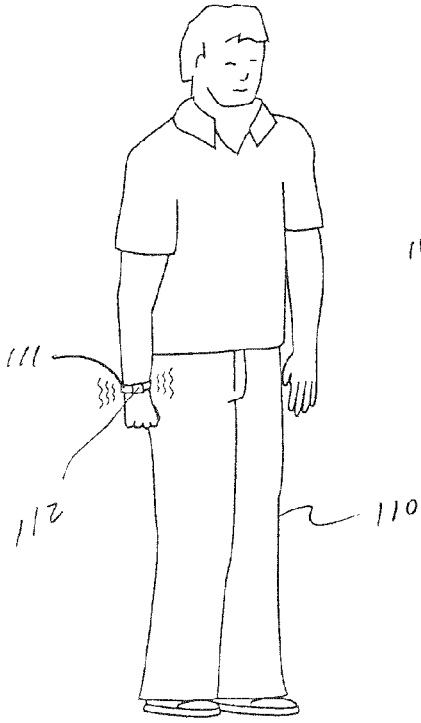
FIG. 6 illustrates a person having a wrist mounted receiver to provide an indication of potential tampering or intrusion by an unauthorized person.
Figure 7:
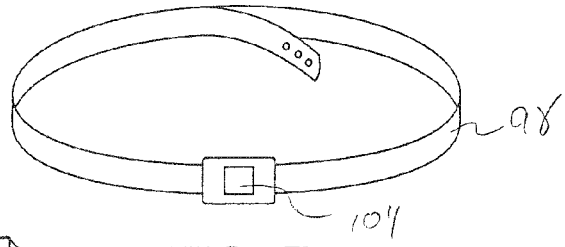
FIGS. 7 and 8 illustrate embodiments of pet collars supporting either a magnet or a transmitter for unlocking a pet door.
Figure 10:
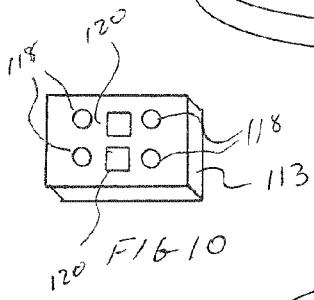
FIG. 10 illustrates a unit for providing indicia of the location activating an alarm.
Figure 8:
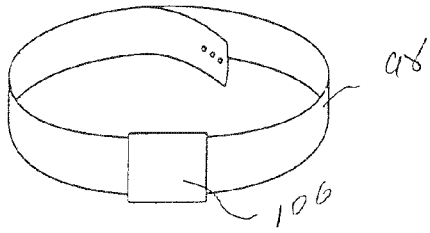

As shown in FIG. 6, an authorized person 110 may carry a receiver 112 for receiving a signal, which receiver may be worn as a wrist band 111. Receiver 112 may be a radio frequency receiver, an infrared frequency receiver, or a receiver for an inaudible sound. Additionally, a unit 113, as shown in FIG. 10, may be incorporated to identify the location of the signal transmitted. This unit may include visually perceivable indicia 118 or audible generators 120 identifying the location of the door or window subjected to tampering or intrusion.

Figure 9:
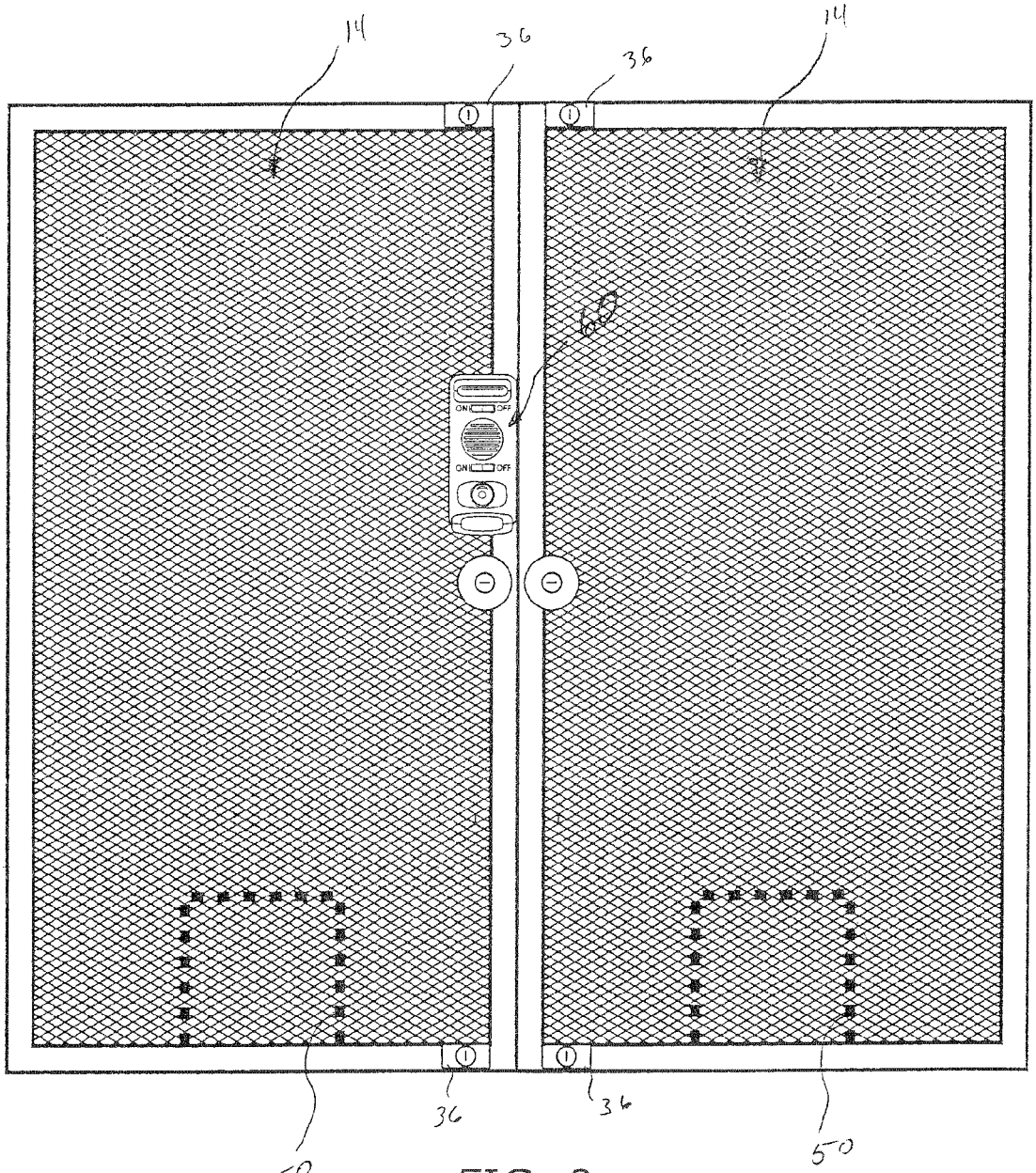
FIG. 9 illustrates use of the present invention as representative French doors.

Referring to FIG. 9, there is shown a pair of screen doors 14 mounted in the manner of French doors. One or both of the screen doors may include a pet door 50, as representatively illustrated in dashed lines. All of the other features described above with respect to FIGS. 1-8 may be incorporated in the screen doors shown in FIG. 9.

I claim:

1. A secure screen unit mounted within a supporting frame for preventing unauthorized tampering and intrusion, said screen unit comprising in combination:

a) a robust metal mesh having a perimeter;

b) a metal frame engaging the perimeter of said mesh for supporting and for preventing relative movement between said metal frame and said mesh, the robust metal mesh and the metal frame together forming the screen unit;

c) at least one locking device mounted on said metal frame for securing said screen unit with the supported frame;

d) at least one sensor for providing a signal indicative of movement of said screen unit or tampering with said screen unit; and e) a control unit mounted to the screen unit, the control unit accessible at the screen unit for directly activating and deactivating the at least one sensor and for providing an alarm upon receipt of a signal from the at least one sensor.

2. The screen unit as set forth in claim 1, wherein said screen unit is a screen door and including a pet door formed in said screen door, said pet door including a lock for preventing opening of said pet door, a signal generating element carried by a pet for unlocking said lock and a sensor for sensing the generated signal when the pet is in proximity to said pet door.

3. The screen unit as set forth in claim 2 wherein said lock is coupled with said control unit to generate an alarm upon unauthorized movement of said pet door.

4. The screen unit as set forth in claim 2 wherein said pet door is hingedly attached to said screen door.

5. The screen unit as set forth in claim 2, including an insect screen, said insect screen including an opening sized commensurate with a pet door formed in said screen door.

6. The screen unit as set forth in claim 1, including a receiver for receiving a signal from said control unit upon generation of a signal from said control unit.

7. The screen unit as set forth in claim 6 wherein said receiver may be carried by a person.

8. The screen unit as set forth in claim 1, including an insect screen detachably attached to said screen unit to prevent intrusion of insects.

9. The screen unit as set forth in claim 8 wherein said insect screen is magnetically attached to said screen unit.

10. The screen unit as set forth in claim 9 wherein said insect screen includes magnetic elements disposed on a border magnetically responsive to said metal frame of said screen unit.

11. The screen unit as set forth in claim 9 wherein said insect screen includes a border for supporting a plurality of magnets magnetically responsive to corresponding sections on said metal frame.

12. The screen unit as set forth in claim 1, including a camera responsive to a signal from said control unit to obtain an image of an unauthorized intruder and of a person tampering with said screen unit.

13. The screen unit as set forth in claim 1, including an audible alarm responsive to a signal from said control unit.

14. The screen unit as set forth in claim 1, including a telephone connection to a location for summoning assistance in response to a signal from said control unit.

15. The screen unit as set forth in claim 1 wherein said signal generating element is an RF transmitter.

16. The screen unit as set forth in claim 1 wherein said signal generating element generates an inaudible signal.

17. The screen unit as set forth in claim 1 wherein said signal generating element generates a signal in the IR frequency range.

18. The screen unit as set forth in claim 1 wherein at least one of said locking devices is disposed at the top and bottom of said metal frame.

19. The screen unit as set forth in claim 18 wherein at least one of said locking devices is disposed on a side of said metal frame.

20. The screen unit as set forth in claim 1, wherein said screen unit is a screen door and including a pair of said screen doors mounted as French doors within a door frame.

21. The screen unit as set forth in claim 1 wherein said screen unit is a window.

22. The screen unit as set forth in claim 21, including a camera responsive to a signal from said control unit to obtain an image of an unauthorized intruder and of a person tampering with said screen unit.

23. The screen unit as set forth in claim 21, including an audible alarm responsive to a signal from said control unit.

24. The screen unit as set forth in claim 21, including a telephone connection to a location for summoning assistance in response to a signal from said control unit.

25. The screen unit as set forth in claim 21 wherein said signal generating element is an RF transmitter.

26. The screen unit as set forth in claim 21 wherein said signal generating element generates an inaudible signal.

27. The screen unit as set forth in claim 21 wherein said signal generating element generates a signal in the IR frequency range.

* * * * *